US008174515B2

(12) United States Patent
Jeong et al.

(10) Patent No.: US 8,174,515 B2
(45) Date of Patent: May 8, 2012

(54) METHOD OF DRIVING A DISPLAY PANEL AND DISPLAY APPARATUS FOR PERFORMING THE METHOD

(75) Inventors: Jae-Won Jeong, Seoul (KR); Bong-Im Park, Cheonan-si (KR); Bong-Ju Jun, Cheonan-si (KR); Yun-Jae Kim, Asan-si (KR); Yong-Jun Choi, Cheonan-si (KR); Dong-Beom Cho, Asan-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 540 days.

(21) Appl. No.: 12/413,221

(22) Filed: Mar. 27, 2009

(65) Prior Publication Data

US 2010/0007639 A1 Jan. 14, 2010

(30) Foreign Application Priority Data

Jul. 11, 2008 (KR) ..... 10-2008-0067526

(51) Int. Cl.
*G09G 5/00* (2006.01)

(52) U.S. Cl. ..... 345/204; 345/84; 345/690

(58) Field of Classification Search ..... None
See application file for complete search history.

(56) References Cited

U.S. PATENT DOCUMENTS

| | | | | |
|---|---|---|---|---|
| 7,728,801 | B2 * | 6/2010 | Tsai et al. | 345/87 |
| 7,800,597 | B2 * | 9/2010 | Hong | 345/204 |
| 7,898,536 | B2 * | 3/2011 | Shin et al. | 345/204 |
| 2008/0218463 | A1 * | 9/2008 | Lee et al. | 345/89 |

FOREIGN PATENT DOCUMENTS

| | | |
|---|---|---|
| JP | 2006-235417 | 9/2006 |
| KR | 10-2006-0089831 | 8/2006 |
| KR | 10-2006-0111262 | 10/2006 |

* cited by examiner

*Primary Examiner* — Joseph Haley
(74) *Attorney, Agent, or Firm* — H.C. Park & Associates, PLC

(57) ABSTRACT

In a method of driving a display panel and a display apparatus for performing the method, a first pixel equipped in the display panel is driven with a first data voltage to which a first gamma curve is applied and a second pixel adjacent to the first pixel is driven with a second data voltage to which a second gamma curve is applied during an (N)-th frame, wherein N is a natural number. The first pixel and the second pixel is driven with a third data voltage to which a third gamma curve having a luminance between the first gamma curve and the second gamma curve is applied during a (N+1)-th frame.

17 Claims, 7 Drawing Sheets

METHOD OF DRIVING A DISPLAY PANEL AND DISPLAY APPARATUS FOR PERFORMING THE METHOD

CROSS REFERENCE TO RELATED APPLICATION

This application claims priority from and the benefit of Korean Patent Application No. 2008-67526, filed on Jul. 11, 2008, which is hereby incorporated by reference for all purposes as if fully set forth herein.

BACKGROUND OF THE INVENTION

1. Field of the Invention

The present invention relates to a method of driving a display panel and a display apparatus for performing the method. More particularly, exemplary embodiments of the present invention relate to a method of driving a display panel capable of improving side visibility and a display apparatus for performing the method.

2. Discussion of the Background

Generally, a liquid crystal display (LCD) apparatus displays an image by applying a voltage to a liquid crystal layer interposed between two substrates to control a light transmittance.

The LCD apparatus has a disadvantage in that a viewing angle is relatively narrow since light is passed through only in the direction in which light is not blocked by liquid crystal molecules of the liquid crystal layer to display an image. As a result, a vertical alignment (VA) LCD apparatus has been developed.

The VA LCD apparatus includes two substrates that have received VA treatments on opposite faces and a liquid crystal layer having negative type dielectric constant anisotropy sealed between the two substrates. The liquid crystal molecules of the liquid crystal layer have homeotropic alignment characteristics.

In an operation, when a voltage is not applied between the two substrates, the liquid crystal molecules are arranged approximately vertically to the surface of the substrate to display black. When a certain voltage is applied between the two substrates, the liquid crystal molecules are arranged approximately horizontally to the surface of the substrate to display white. When a smaller voltage than the voltage for displaying white is applied, the liquid crystal molecules are arranged to be diagonally inclined to the surface of the substrate to display gray.

Such an LCD apparatus has a disadvantage in that the viewing angle may be narrow. Patterned vertical alignment (PVA) and super-PVA (SPVA) LCD apparatuses have been developed to address this.

The PVA LCD apparatus uses technology that arranges the liquid crystal molecules vertically to the surface of the substrate and forms uniform slit patterns or projection patterns on pixel electrodes and a common electrode opposite to the pixel electrodes to divide pixels into multiple domains. The PVA LCD apparatus is a technique which divides a pixel into two sub-pixels and applies different pixel voltages to the sub-pixels. Here, the sub-pixels have different distribution characteristics of the liquid crystal to improve side visibility.

However, the above method requires a patterning process for forming the sub-pixels, and transmittance may be decreased by patterning.

SUMMARY OF THE INVENTION

The present invention provides a method of driving a display panel capable of improving side visibility without dividing a pixel into sub-pixels.

The present invention also provides a display apparatus for performing the above-mentioned method.

Additional features of the invention will be set forth in the description which follows, and in part will be apparent from the description, or may be learned by practice of the invention.

The present invention discloses a method of driving a display image. In the method, a first data voltage, to which a first gamma curve is applied, is applied to a first pixel of a display panel, and a second data voltage, to which a second gamma curve is applied, is applied to a second pixel adjacent to the first pixel, during an (N)-th frame, wherein N is a natural number. Then, a third data voltage and a fourth data voltage, to which a third gamma curve having a luminance between the first gamma curve and the second gamma curve is applied, are applied to the first pixel and the second pixel, respectively, during an (N+1)-th frame.

The present invention also discloses a display apparatus including a display panel and a driving apparatus. The display panel includes a first pixel and a second pixel adjacent to the first pixel. The driving apparatus applies a first data voltage, to which a first gamma curve is applied, to the first pixel during an (N)-th frame, wherein N is a natural number, applies the second data voltage, to which a second gamma curve is applied, to the second pixel during the (N)-th frame, and applies a third data voltage and a fourth data voltage, to which the third gamma curve is applied and having a luminance between the first gamma curve and second gamma curve, to the first pixel and second pixel, respectively, during an (N+1)-th frame.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
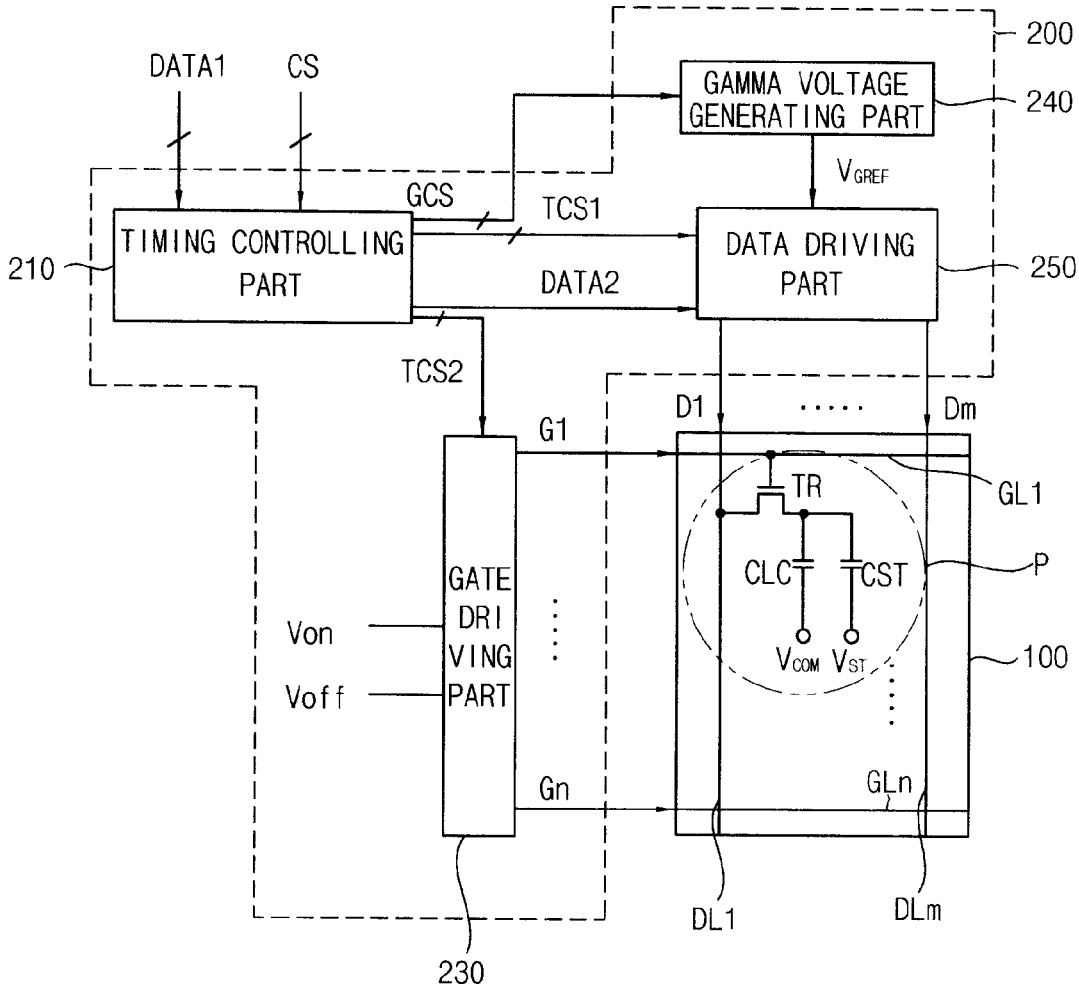
FIG. 1 is a block diagram of a display apparatus according to a first exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of the present invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Exemplary embodiments of the invention are described herein with reference to cross-sectional illustrations that are schematic illustrations of idealized exemplary embodiments (and intermediate structures) of the present invention. As such, variations from the shapes of the illustrations as a result, for example, of manufacturing techniques and/or tolerances, are to be expected. Thus, exemplary embodiments of the present invention should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present invention will be explained in detail with reference to the accompanying drawings.

Figure 2:
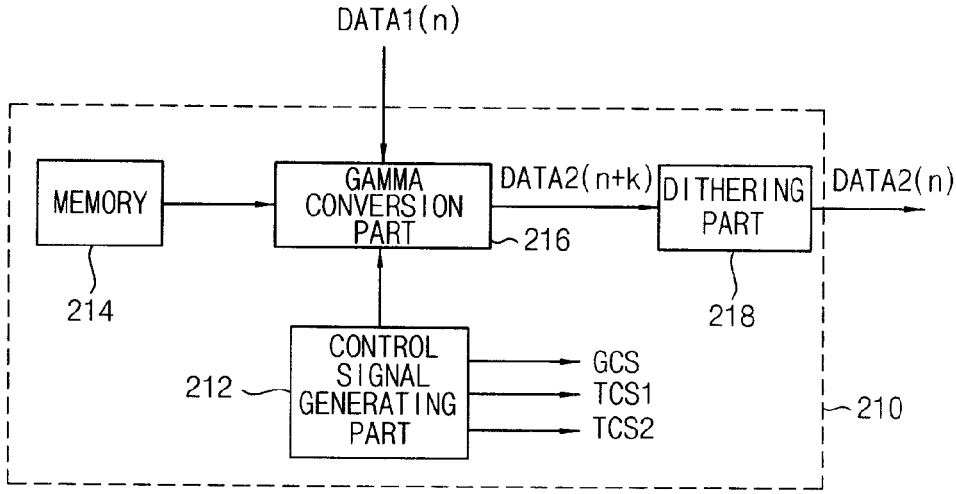
FIG. 2 is a block diagram showing a timing controlling part of FIG. 1.

FIG. 1 is a block diagram showing a display apparatus according to a first exemplary embodiment of the present invention. FIG. 2 is a block diagram showing a timing controlling part of FIG. 1.

Referring to FIG. 1 and FIG. 2, a display apparatus includes a display panel 100 and a driving apparatus 200 driving the display panel 100.

The display panel 100 may have a pseudo-super-patterned vertical alignment (P-SPVA) mode. The display panel 100 includes a plurality of pixels connected to a plurality of gate lines GL1 to GLn and a plurality of date lines DL1 to DLm. Each pixel 'P' includes a thin-film transistor (TFT) TR and a liquid crystal capacitor CLC and a storage capacitor CST connected to the TFT TR.

The driving apparatus 200 applies a data voltage to which different gamma curves are applied on adjacent pixels of the display panel 100, and applies a data voltage to which different gamma curves are applied on the same pixel in frame unit. For example, the driving apparatus 200 applies the first data voltage, to which the first gamma curve is applied, to the first pixel equipped in the display panel 100, and applies the second data voltage, to which the second gamma curve is applied, to the second pixel adjacent to the first pixel, during the (N)-th frame. Also, the driving apparatus 200 applies the third and fourth data voltages, to which the third gamma curve, having a luminance between the first and the second gamma curves, is applied, to the first and second pixels during the (N+1)-th frame.

The driving apparatus 200 includes a timing controlling part 210, a gate driving part 230, a gamma voltage generating part 240, and a data driving part 250.

The timing controlling part 210 receives an input image data DATA1 and a control signal CS provided from a host system such as an external graphic controller (not shown). The control signal CS may include a vertical synchronizing signal, a horizontal synchronizing signal, a main clock, a data enable signal, etc.

The timing controlling part 210 includes a control signal generating part 212, a memory 214, a gamma conversion part 216, and a dithering part 218.

The control signal generating part 212 receives the control signal CS to generate the first timing control signal TCS1 for controlling a driving timing of the data driving part 250 and the second timing control signal TCS2 for controlling a driving timing of the gate driving part 230. The first timing control signal TCS1 may include a horizontal start signal, an inversion signal, an output enable signal, etc. The second timing control signal TCS2 may include a vertical start signal, a gate clock signal, an output enable signal, etc. The first timing control signal TCS1 is outputted to the data driving part 250, and the second timing control signal TCS2 is outputted to the gate driving part 230. Moreover, the timing controlling part 210 may generate a gamma control signal GCS to output to the gamma voltage generating part 240.

Figure 3:
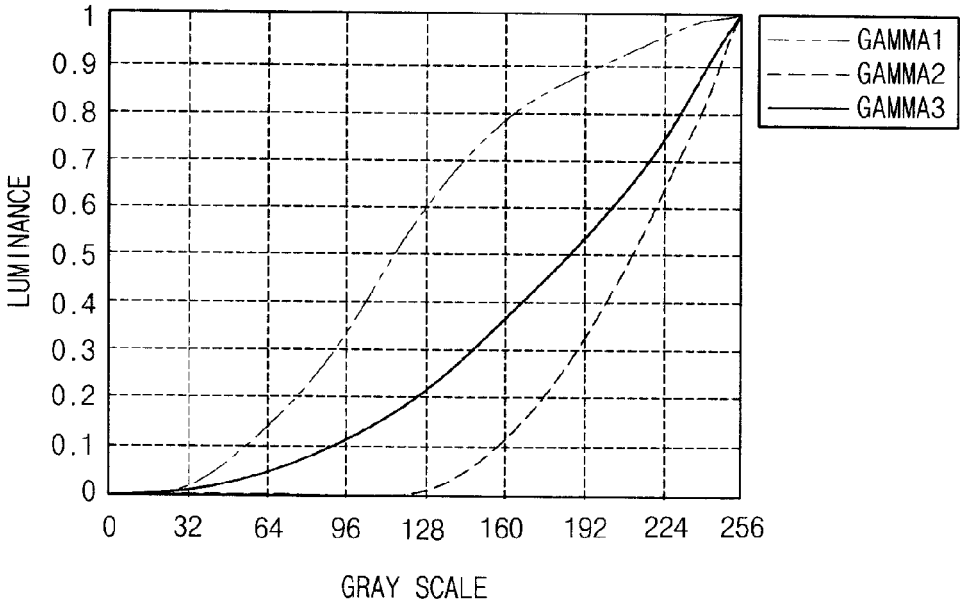
FIG. 3 is a graph showing gamma curves stored in the memory of FIG. 2.

FIG. 3 is a graph showing gamma curves stored in the memory of FIG. 2.

Referring to FIG. 1, FIG. 2, and FIG. 3, the memory 214 stores information for the first gamma curve GAMMA1, information for the second gamma curve GAMMA2, and information for the third gamma curve GAMMA3, which has a luminance between the first gamma curve GAMMA1 and the second gamma curve GAMMA2, in look-up table (LUT) format. A luminance of the first gamma curve GAMMA1 is higher than that of the second gamma curve GAMMA2.

When an input image data DATA1 is input from an external device, the gamma conversion part 216 selects at least one of the first to the third gamma curves GAMMA1, GAMMA2, and GAMMA3 that are stored in the memory 214, and outputs the input image data DATA1 as conversion data DATA2 by using the selected gamma curve. The gamma conversion part 216 converts the input image data DATA1 applied to the same pixel into the conversion data DATA2 by applying different gamma curves frame by frame. The input image data DATA1 may include the first image data corresponding to the first pixel and the second image data corresponding to the second pixel adjacent to the first pixel.

For example, the gamma conversion part 216 may convert the first image data corresponding to the first pixel of consecutive four frame data by applying in order the first gamma curve GAMMA1, the third gamma curve GAMMA3, the first gamma curve GAMMA1, and the third gamma curve GAMMA3. The gamma conversion part 216 may then convert the second image data corresponding to the second pixel of consecutive four frame data by applying in order the second gamma curve GAMMA2, the third gamma curve GAMMA3, the second gamma curve GAMMA2, and the third gamma curve GAMMA3.

Also, the gamma conversion part 216, as described above, may convert the first image data corresponding to the first pixel of consecutive four frame data by applying in order the first gamma curve GAMMA1, the third gamma curve GAMMA3, the second gamma curve GAMMA2, and the third gamma curve GAMMA3. The gamma conversion part 216 may convert the second image data corresponding to the second pixel of consecutive four frame data by applying in order the second gamma curve GAMMA2, the third gamma curve GAMMA3, the first gamma curve GAMMA1, and the third gamma curve GAMMA3.

When the input image data DATA1 is n bits (i.e., 8 bits), the conversion data DATA2 converted though the gamma conversion part 216 may be n+k bits of conversion data DATA2 expanded by k bits (i.e., 2 bits).

The dithering part 218 dithers the n+k bits of conversion data DATA2 input from the gamma conversion part 216 into the n bits of conversion data DATA2 to output to the data driving part 250.

The gate driving part 230 outputs gate signals G1 to Gn in sequence activating the gate lines GL1 to GLn to the display panel 100, in response to the second timing control signal TCS2 input from the timing controlling part 210 and gate on or off voltages Von/Voff input from the external device.

The gamma voltage generating part 240 generates a plurality of gamma reference voltages $V_{GREF}$ based on the gamma control signal GCS provided from the timing controlling part 210 and outputs the generated a plurality of gamma reference voltages $V_{GREF}$ to the data driving part 250.

The gamma voltage generating part 240 may consist of an R-string to which a plurality of resistors are connected in series between a gamma power supply voltage and a ground power supply voltage and generate the gamma reference voltage $V_{GREF}$ with voltage distributing the voltage difference applied to both end of the gamma power supply voltage and the ground power supply voltage according to the gamma control signal GCS.

The data driving part 250 converts the conversion data DATA2 into an analog data voltage using the gamma reference voltage $V_{GREF}$ received from the gamma voltage generating part 240.

As described above, according to the present exemplary embodiment, the data voltage, to which different gamma curves are applied, is applied to the adjacent first and second pixels in a frame, and side visibility may be assured by applying the data voltage to which different gamma curves are applied on the same pixel of each frame. Moreover, according to the present exemplary embodiment, as a rapid change in luminance between frames is not shown, when color data is displayed, color distortion may be prevented from being generated due to rapid variation of the luminance between adjacent frames.

Figure 4A:
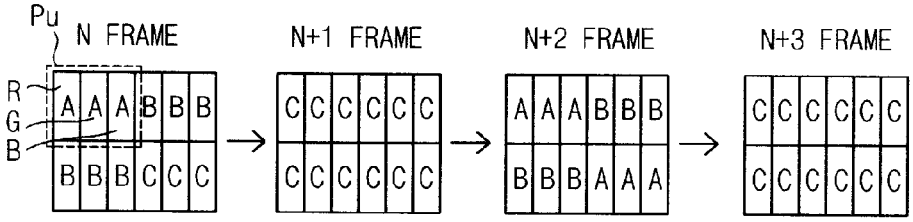
FIG. 4A is a conceptual diagram schematically showing a method of driving a display panel according to one embodiment of the present invention.
Figure 4B:
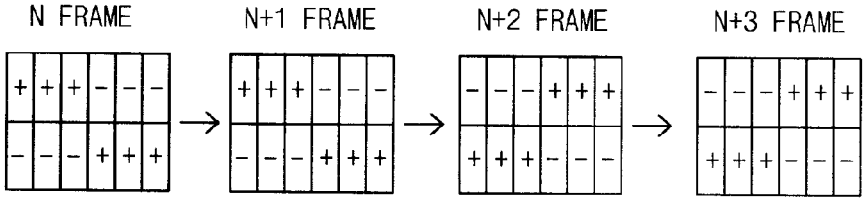
FIG. 4B is a conceptual diagram schematically showing polarities of data voltages applied to each pixels of the display panel of FIG. 4A.
Figure 4C:
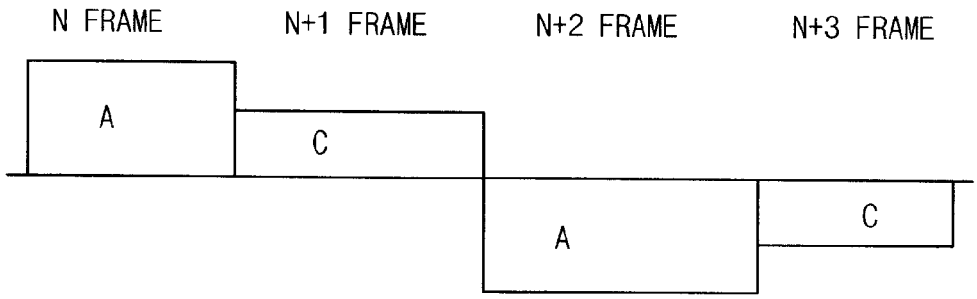
FIG. 4C is a waveform diagram schematically showing polarities of data voltages applied to each pixels corresponding to a first gate line of the display panel of FIG. 4B.
Figure 4D:
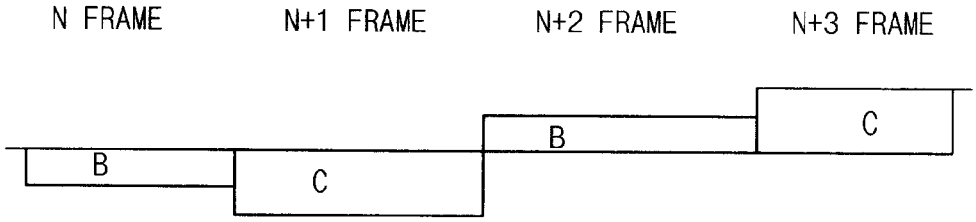
FIG. 4D is a waveform diagram schematically showing polarities of data voltages applied to each pixels corresponding to a second gate line of the display panel of FIG. 4B.

FIG. 4A is a conceptual diagram schematically showing a method of driving a display panel according to another embodiment of the present invention. FIG. 4B is a conceptual diagram schematically showing polarities of data voltages applied to each pixel of the display panel of FIG. 4A. FIG. 4C is a waveform diagram schematically showing polarities of data voltages applied to each pixel corresponding to a first gate line of the display panel of FIG. 4B. FIG. 4D is a waveform diagram schematically showing polarities of data voltages applied to each pixel corresponding to a second gate line of the display panel of FIG. 4B.

Referring to FIG. 1, FIG. 2, and FIG. 4, the gamma conversion part 216 converts the first image data corresponding to the first pixel of the (N)-th frame of data into the first conversion data by applying the first gamma curve GAMMA1, and converts the second image data corresponding to the second pixel of the (N)-th frame of data into the second conversion data by applying the second gamma curve GAMMA2, and outputs the first and second conversion data to the data driving part 250. The first pixel is the first unit pixel Pu including a red R, a green G, and a blue B sub-pixel, and the second pixel is the second unit pixel adjacent to the first unit pixel Pu. The control signal generating part 212 generates inversion signals for the first and the second conversion data to transmit the inversion signals to the data driving part 250.

The data driving part 250 converts the first conversion data into the first data voltage A of an analog format and converts the second conversion data into the second data voltage B of an analog format using the gamma reference voltage $V_{GREF}$. Then, the data driving part 250 correspondingly inverts the first and the second data voltages A, B to the inversion signal to output on the display panel 100. Accordingly, the first data voltage A of the first polarity is applied to the first pixel and the second data voltage B of the second polarity opposite to the first polarity is applied to the second pixel during the (N)-th frame. The first polarity may be a positive polarity (+) with respect to a common voltage ($V_{COM}$), and the second polarity may be a negative polarity (−) with respect to a common voltage ($V_{COM}$).

The gamma conversion part 216 converts the first and the second image data into the third conversion data to output by applying the third gamma curve GAMMA3 to the data driving part 250. The control signal generating part 212 generates an inversion signal for the third conversion data to output the inversion signal to the data driving part 250. The data driving part 250 converts the third conversion data into the third data voltage and the fourth data voltage C of an analog format using the gamma reference voltage $V_{GREF}$ and correspondingly inverts the third and the fourth data voltages C to the inversion signal to output on the display panel 100. Then, the third data voltage C of the first polarity is applied to the first pixel, and the fourth data voltage C of the second polarity is applied to the second pixel during (N+1)-th frame.

The gamma conversion part 216 converts the first image data of (N+1)-th frame data into the fourth conversion data and converts the second image data corresponding to the second pixel into the fifth conversion data by applying the second gamma curve GAMMA2 to output them to the data driving part 250. The control signal generating part 212 generates inversion signals for the fourth and the fifth conversion data to output them to the data driving part 250.

The data driving part 250 converts the fourth conversion data into the fifth data voltage A of an analog format and converts the fifth conversion data into the sixth data voltage B of an analog format using the gamma reference voltage $V_{GREF}$ to output them on the display panel 100. The fifth data voltage A of the second polarity is applied to the first pixel and the sixth data voltage B of the first polarity is applied to the second pixel during the (N+2)-th frame.

The gamma conversion 216 converts the first and the second image data of (N+3)-th frame into the sixth conversion data using a gamma value by applying the third gamma curve GAMMA3 to output to the data driving part 250. The control signal generating part 212 generates an inversion signal for the sixth conversion data to output the inversion signal to the data driving part 250.

The data driving part 250 converts the sixth conversion data into the sixth data voltage and the seventh data voltage C of an analog format using the gamma reference voltage $V_{GREF}$ and correspondingly inverts the sixth data voltage C to the inversion signal to output on the display panel 100 during the (N+3)-th frame. Then, the sixth data voltage C of the second polarity is applied to the first pixel and the seventh data voltage C of the first polarity is applied to the second pixel during the (N+3)-th frame.

As shown in FIG. 4A and FIG. 4B, the conversion data has a period of four frames, and polarities of the data voltages corresponding to the conversion data have a dot inversion and a two frame inversion formats. The control signal generating part 212 makes phases of the voltage of the conversion data to which the identical gamma curve is applied opposed when generating inversion signals for the conversion data.

FIG. 4C illustrates data voltages applied to the first pixel and FIG. 4D illustrates data voltages applied to the second pixel. As illustrated in FIG. 4C and FIG. 4D, in the present exemplary embodiment, the case when the polarity of the data voltages applied to the first pixel and the second pixel has a two frame inversion format is explained as an example, but is not limited thereto. That is, the polarity of the data voltages may have a variety of inversion formats in the range of making an average, without biasing.

Also, in the present exemplary embodiment, the case when all of three sub-pixels included in a unit pixel are converted in order to have the same gamma characteristic is explained as an example, but is not limited to this. For example, three sub-pixels may be converted in order to have different gamma characteristics.

Alternately, the first pixel and the second pixel may be driven by a frequency of the range of about 60 Hz to about 240 Hz. For example, the first pixel and the second pixel may be driven by a frequency of about 60 Hz, about 120 Hz, and about 240 Hz.

Figure 5A:
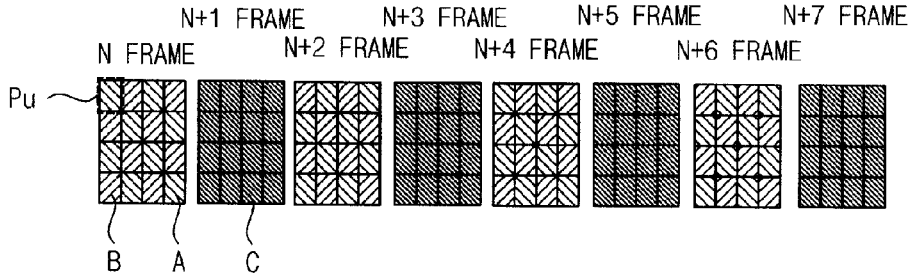
FIG. 5A is a conceptual diagram schematically showing a method of driving a display panel according to one embodiment of the present invention.
Figure 5B:
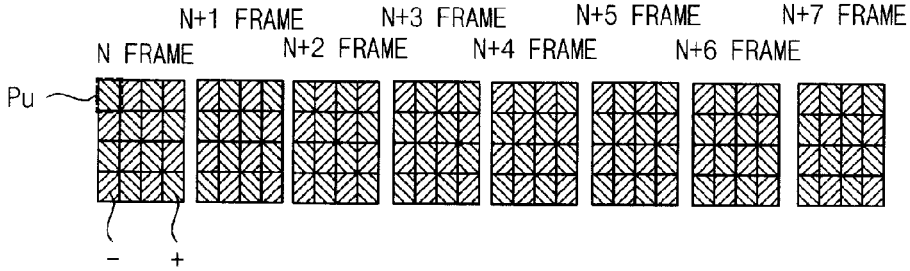
FIG. 5B is a conceptual diagram schematically showing polarities of data voltages applied to each pixel of the display panel of FIG. 5A.
Figure 5C:
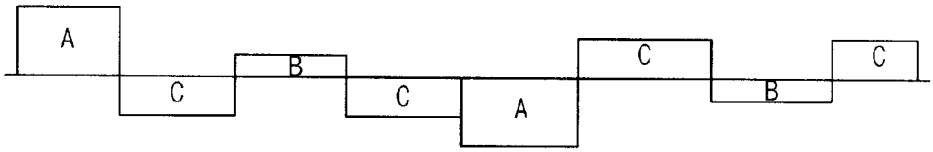
FIG. 5C is a waveform diagram schematically showing polarities of data voltages applied to each pixel and corresponding to a first gate line of the display panel of FIG. 5B.
Figure 5D:
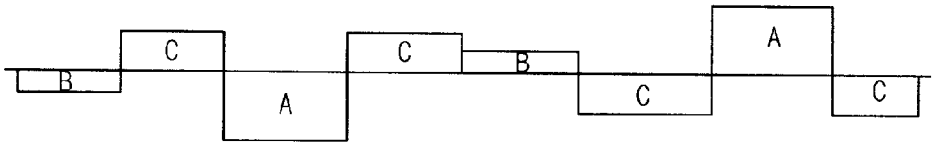
FIG. 5D is a waveform diagram schematically showing polarities of data voltages applied to each pixel and corresponding to a second gate line of the display panel of FIG. 5B.

FIG. 5A is a conceptual diagram schematically showing a method of driving a display panel according to one embodiment of the present invention. FIG. 5B is a conceptual diagram schematically showing polarities of data voltages applied to each pixels of the display panel of FIG. 5A. FIG. 5C is a waveform diagram schematically showing polarities of data voltages applied to each pixel corresponding to a first gate line of the display panel of FIG. 5B. FIG. 5D is a waveform diagram schematically showing polarities of data voltages applied to each pixel corresponding to a second gate line of the display panel of FIG. 5B. A method of driving a display panel according to another embodiment of the present invention is identical to the method of driving a display panel according to the embodiment described in FIG. 4A, FIG. 4B, FIG. 4C, and FIG. 4D except that the inversion signal is converted by eight frame periods, as a pattern of the conversion data is converted, thus a detailed description repeated will omitted.

Referring to FIG. 5A, FIG. 5B, FIG. 5C, and FIG. 5D, a first data voltage A, corresponding to the first conversion data to which the first gamma curve GAMMA1 is applied, is applied to the first pixel. A second data voltage B, corresponding to the second conversion data to which the second gamma curve GAMMA2 is applied, is applied to the second pixel during an (N)-th frame. The first data voltage A has a first polarity and the second data voltage B has a second polarity opposite to the first polarity. The first polarity may be a positive polarity (+) with respect to a common voltage ($V_{COM}$), and the second polarity may be a negative polarity (−) with respect to a common voltage ($V_{COM}$).

A third data voltage and the fourth data voltage C, corresponding to the conversion data to which the third gamma curve GAMMA3 is applied, is applied to the first pixel and the second pixel during an (N+1)-th frame. The third data voltage C of the second polarity is applied to the first pixel, and the fourth data voltage C of the first polarity is applied to the second pixel.

A fifth data voltage B, corresponding to the fourth conversion data to which the second gamma curve GAMMA2 is applied, is applied to the first pixel, and a sixth data voltage A, corresponding to the fifth conversion data converted by the first gamma curve GAMMA1, is applied to the second pixel during a (N+2)-th frame. The fifth data voltage B has the first polarity, and the sixth data voltage A has the second polarity.

A seventh data voltage and an eighth data voltage C, corresponding to the conversion data to which the third gamma curve GAMMA3 is applied, are applied to the first pixel and the second pixel, respectively, during an (N+3)-th frame. The seventh data voltage C of the second polarity is applied to the first pixel, and the eighth data voltage C of the first polarity is applied to the second pixel.

A ninth data voltage A, corresponding to the seventh conversion data to which the first gamma curve GAMMA1 is applied, is applied to the first pixel, and a tenth data voltage B, corresponding to the eighth conversion data to which the second gamma curve GAMMA2 is applied, is applied to the second pixel during a (N+4)-th frame. The ninth data voltage A has the second polarity and the tenth data voltage B has the first polarity.

A eleventh data voltage and a twelfth data voltage C, corresponding to the ninth conversion data to which the third gamma curve GAMMA3 is applied, is applied to the first pixel and the second pixel respectively during a (N+5)-th frame. The eleventh data voltage C of the first polarity is applied to the first pixel and the twelfth data voltage C of the second polarity is applied to the second pixel.

A thirteenth data voltage B, corresponding to the tenth conversion data to which the second gamma curve GAMMA2 is applied, is applied to the first pixel, and a fourteenth data voltage A, corresponding to the eleventh conversion data to which the first gamma curve GAMMA1 is applied, is applied to the second pixel during a (N+6)-th frame. The thirteenth data voltage B has the second polarity and the fourteenth data voltage A has the first polarity.

A fifteenth data voltage and a sixteenth data voltage C, corresponding to the twelfth conversion data to which the third gamma curve GAMMA3 is applied, is applied to the first pixel and the second pixel respectively during a (N+7)-th frame. The fifteenth data voltage C of the first polarity is applied to the first pixel and the sixteenth data voltage C of the second polarity is applied to the second pixel.

The first pixel and the second pixel may be driven by a frequency of the range of about 120 Hz to about 240 Hz. For example, the first pixel and the second pixel may be driven by a frequency of about 120 Hz to about 240 Hz.

Figure 5E:
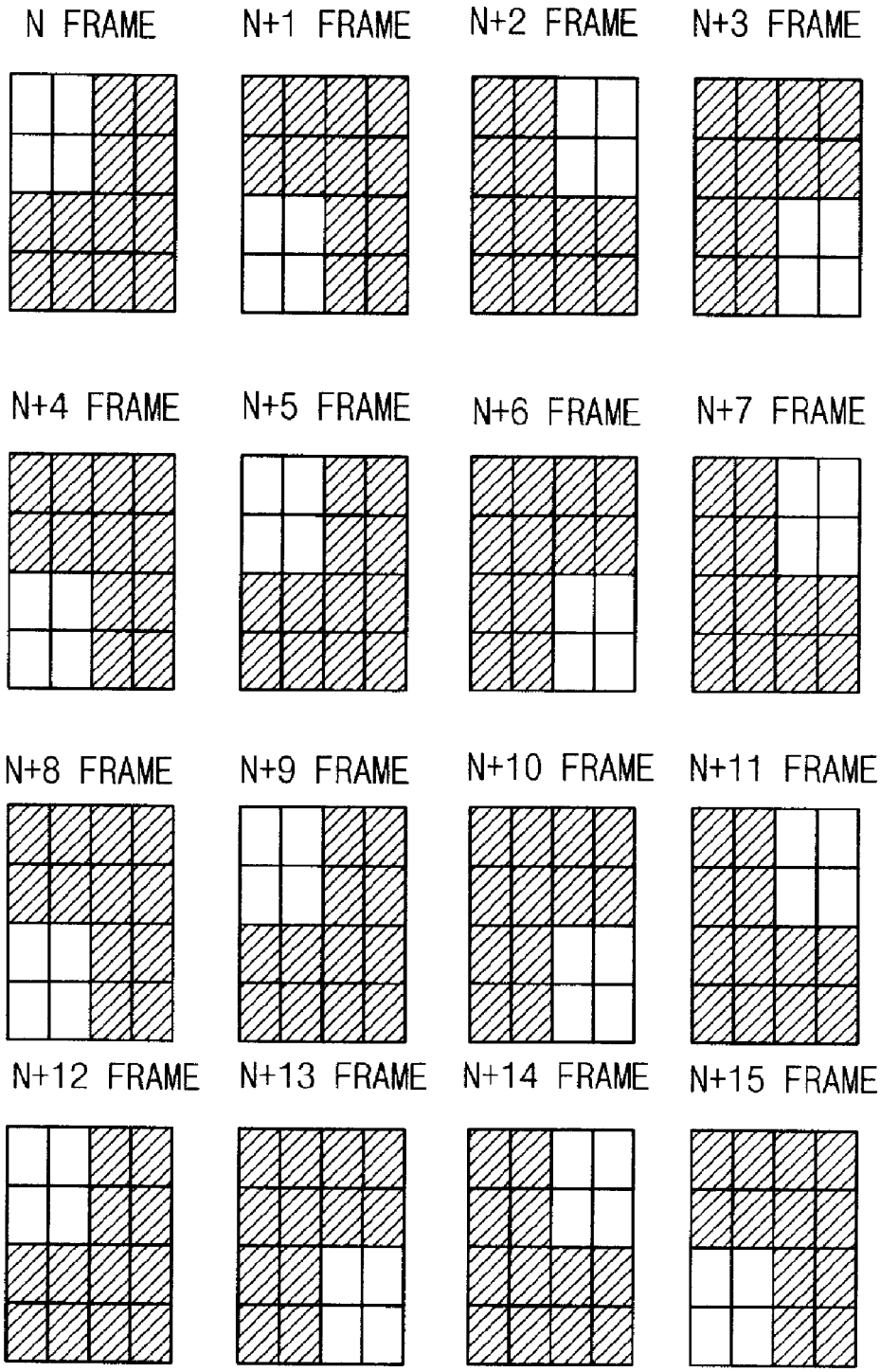
FIG. 5E is a conceptual diagram showing one example of a dithering data pattern.

FIG. 5E is a conceptual diagram showing one example of a dithering data pattern. When the number of bits capable of being processed in the data driving part 250 is smaller than the number of bits of the conversion data input from the gamma conversion part 216, that is, when the number of bits of the conversion data output from the gamma conversion part 216 is 10 bits and the number of bits capable of being processed in the data driving part 250 is 8 bits, the dithering part 218 reconstructs a frame data in order to represent the 10 bits of conversion data in 8 bits. In the present exemplary embodiment, an example of the dithering pattern is constructed by a sixteen frame period. Shaded pixels in FIG. 5E comprise a (n) gray scale corresponding to a high level and unshaded pixels comprise an (n+1) gray scale. In the above example, the changing position of a pixel comprising an (n+1) gray scale according to a frame is to avoid generating a flicker.

Figure 6:
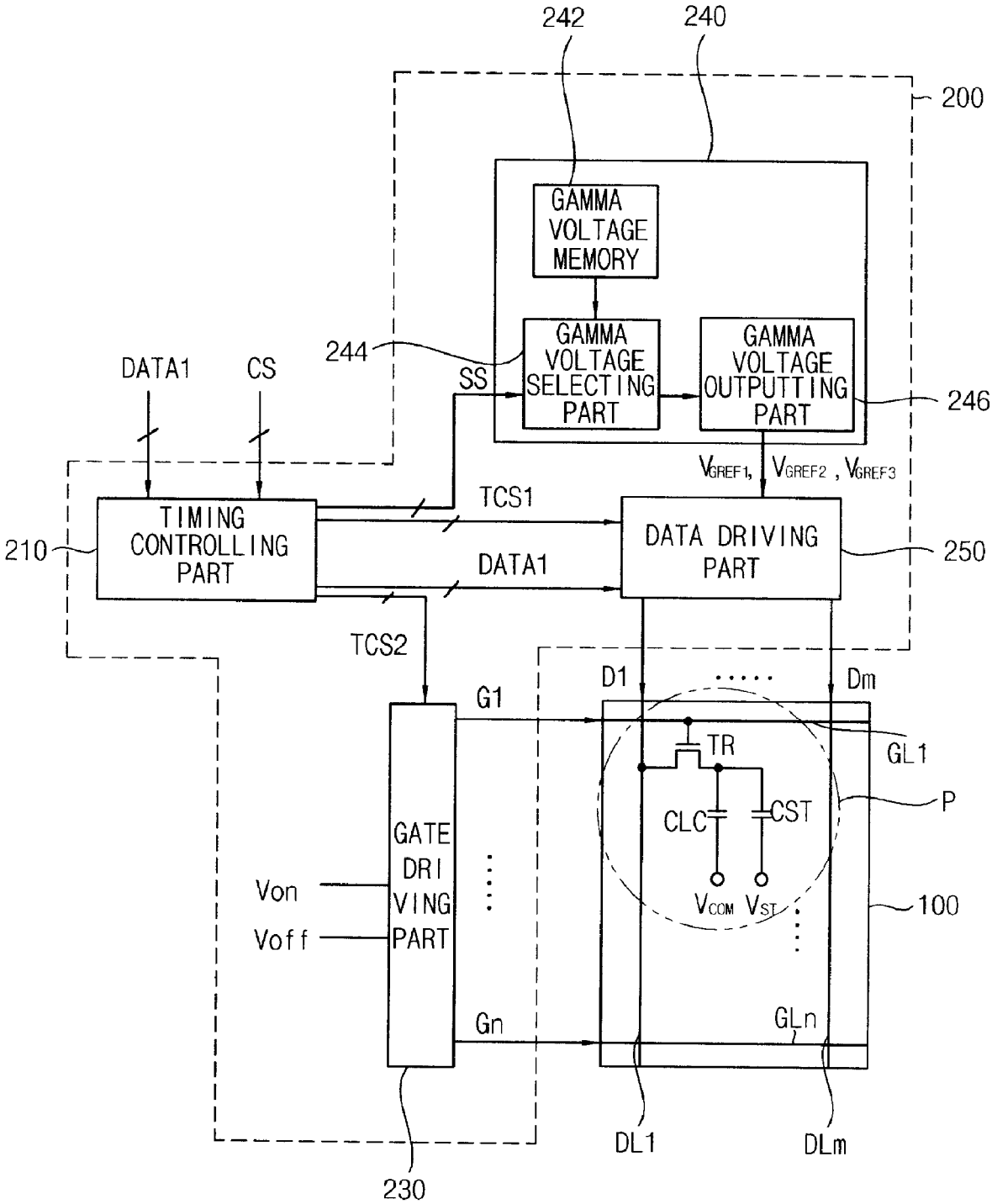
FIG. 6 is a block diagram showing a display apparatus according to a second exemplary embodiment of the present invention.

FIG. 6 is a block diagram for a display apparatus according to a second exemplary embodiment of the present invention.

Referring to FIG. 6, a display apparatus includes a display panel 100 and a driving apparatus 200 driving the display panel 100.

The display panel 100 includes a plurality of pixels electrically connected to a plurality of gate lines (GL1 to GLn) and a plurality of data lines (DL1 to DLm). Each pixel 'P' includes a thin film transistor TR, a liquid crystal capacitor CLC and a storage capacitor CST electrically connected to the thin film transistor TR.

The driving apparatus 200 allows a data voltage, to which different gamma curves are applied, to be applied to adjacent pixels of the display panel 100, respectively, and allows a data voltage, to which different gamma curves are applied, to be applied to the same pixel by a frame unit. For example, the driving apparatus 200 applies a first data voltage, to which a first gamma curve is applied, to a first pixel equipped in the display panel 100 during an (N)-th frame and applies a second data voltage, to which a second gamma curve is applied, to a second pixel adjacent to the first pixel. Then, the driving apparatus 200 applies a third data voltage and a fourth data voltage, to which a third gamma curve having a luminance between the first gamma curve and the second gamma curve is applied, to the first pixel and the second pixel during a (N+1)-th frame.

The driving apparatus 200 includes a timing controlling part 210, a gate driving part 230, a gamma voltage generating part 240 and a data driving part 250.

The timing controlling part 210 receives an image signal DATA1 and a control signal CS provided from a host such as an external graphic controller (not shown). The timing controlling part 210 generates a first timing control signal TCS1 for controlling a driving timing of the data driving part 250 and a second timing control signal TCS2 for controlling a driving timing of the gate driving part 230 using the control signal CS. The first timing control signal TCS1 includes a horizontal start signal, an inversion signal, an output enable signal, etc. The second timing control signal TCS2 includes a vertical start signal, a gate clock signal, an output enable signal, etc.

Moreover, the timing controlling part 210 generates a selection signal SS for selecting a gamma reference voltage to output the selection signal SS to the gamma voltage generating part 240.

The gate driving part 230 outputs gate signal G1 to Gn successively activating the gate lines GL1 to GLn in response to the second timing control signal TCS2 input from the timing controlling part 210 and a gate on or off voltage Von/Voff input from the external device.

The gamma voltage generating part 240 includes a gamma voltage memory 242, a gamma voltage selecting part 244 and a gamma voltage outputting part 246.

Figure 7:
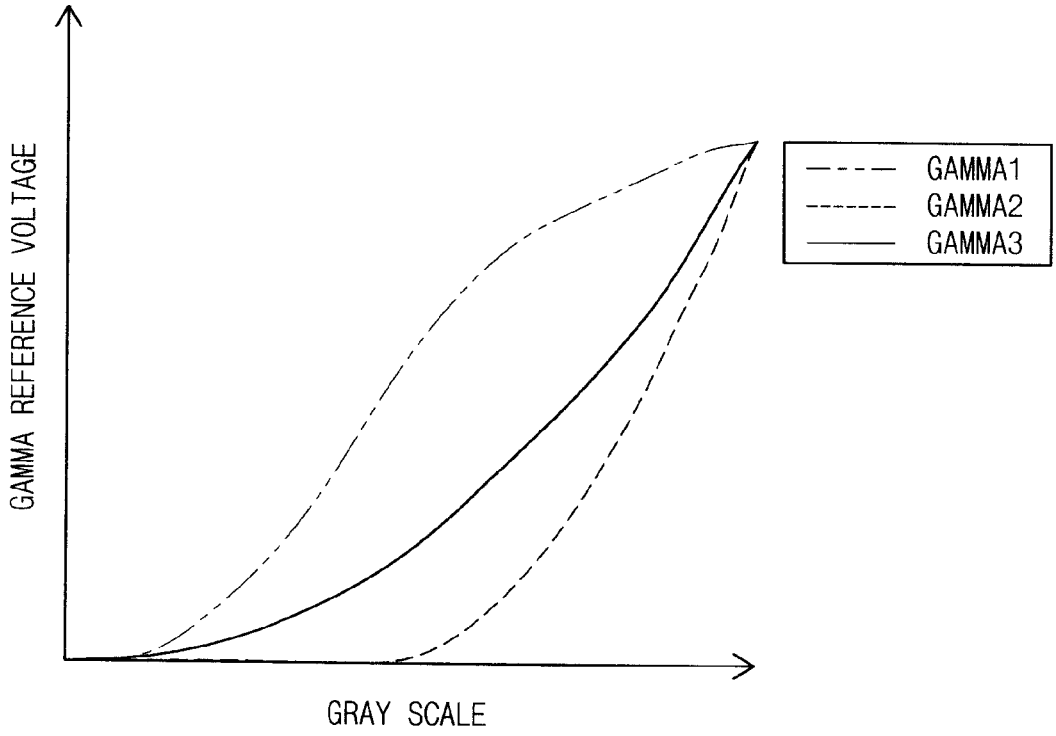
FIG. 7 is a graph showing gamma curves stored in the gamma voltage memory of FIG. 6.

FIG. 7 is a graph showing gamma curves stored in the gamma voltage memory illustrated in FIG. 6.

A first gamma reference voltage $V_{GREF1}$ corresponding to a first gamma curve GAMMA1, a second gamma reference voltage $V_{GREF2}$ corresponding to a second gamma curve GAMMA2, and a third gamma reference voltage $V_{GREF3}$ corresponding to a third gamma curve GAMMA3 between the first gamma curve GAMMA1 and the second gamma curve GAMMA2 are stored in the gamma voltage memory 242. The first gamma reference voltage $V_{GREF1}$ is bigger than the second gamma reference voltage $V_{GREF2}$. The third gamma reference voltage $V_{GREF3}$ is smaller than the first gamma reference voltage $V_{GREF1}$ and bigger than the second gamma reference voltage $V_{GREF2}$.

The gamma voltage selecting part 244 selects at least one of the first gamma reference voltage $V_{GREF1}$ to the third gamma reference voltage $V_{GREF3}$ stored in the gamma voltage memory 242 according to the selection signal SS received from the timing controlling part 210. For example, the gamma voltage selecting part 244 selects the first gamma reference voltage $V_{GREF1}$ and the second gamma reference voltage $V_{GREF2}$ during an odd frame and selects the third gamma reference voltage $V_{GREF3}$ during an even frame in response to the selection signal SS.

The gamma voltage outputting part 246 outputs a gamma reference voltage selected in the gamma voltage selecting part 244 to the data driving part 250.

The data driving part 250 is synchronized with the first timing control signal TCS1 from the timing controlling part 210 to receive the input image data DATA1. Also, the data driving part 250 receives at least one of the first gamma reference voltages $V_{GREF1}$, $V_{GREF2}$, and $V_{GREF3}$ from the gamma voltage generating part 240. The data driving part 250 converts the input image data DATA1 into a data voltage of an analog format based on a gamma reference voltage applied from the gamma voltage generating part 240 to output the data voltage to the display panel 100. The input image data DATA1 may include first image data corresponding to a first pixel, and second image data corresponding to a second pixel adjacent to the first pixel.

For example, the data driving part 250 may convert the first image data corresponding to the first pixel into data voltages of analog formats, successively using i the first gamma reference voltage $V_{GREF1}$, the third gamma reference voltage $V_{GREF3}$, the first gamma reference voltage $V_{GREF1}$, and the third gamma reference voltage $V_{GREF3}$ during four consecutive frames. The data driving part 250 may convert the second image data corresponding to the second pixel into data voltages, successively using the third gamma reference voltage $V_{GREF3}$, the second gamma reference voltage $V_{GREF2}$, and the third gamma reference voltage $V_{GREF3}$.

As another example, the data driving part 250 may convert the first image data corresponding to the first pixel into data voltages of analog formats, successively using the first gamma reference voltage $V_{GREF1}$, the third gamma reference voltage $V_{GREF3}$, the second gamma reference voltage $V_{GREF2}$, and the third gamma reference voltage $V_{GREF3}$. The data driving part 250 may convert the second image data corresponding to the second pixel into data voltages, successively using the second gamma reference voltage $V_{GREF2}$, the third gamma reference voltage $V_{GREF3}$, the first gamma reference voltage $V_{GREF1}$, and the third gamma reference voltage $V_{GREF3}$.

Although not illustrated in the figures, in a method of driving a display panel according to the present embodiment, data voltages, to which different gamma curves are applied, are applied to adjacent first and second pixels. Data voltages, to which different gamma curves are applied, are applied to the same pixel by a frame unit. Repetitive descriptions will be omitted since the method is substantially identical with the method of driving a display panel explained through FIG. 4, FIG. 5A, and FIG. 5B.

As described above, the side visibility of an LCD device may be improved without dividing one pixel into two subpixels as the display apparatus of the SPVA mode, by applying data voltages to which different gamma curves are applied to adjacent first and second pixels inside a frame unit, and applying data voltages, to which different gamma curves are applied, to the same pixel by a frame unit according to the present embodiments. Moreover, the above method may prevent a rapid change in data of a high gamma to a low gamma, by altering the gamma characteristic of data applied in the same pixel by a frame unit. Color distortion due to a rapid change in luminance between adjacent frames when color data is displayed may therefore be prevented. Thus, according to the present invention, the above method may improve the display quality of a display apparatus.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A method for driving a display panel, the method comprising:

applying a first data voltage, to which a first gamma curve is applied, to a first pixel of a display panel, and applying a second data voltage, to which a second gamma curve is applied, to a second pixel adjacent to the first pixel, during an (N)-th frame; and applying a third data voltage and a fourth data voltage, to which a third gamma curve is applied, to the first pixel and the second pixel, respectively, during a (N+1)-th frame, wherein the third gamma curve has a luminance between the first gamma curve and the second gamma curve, and N is a natural number.

2. The method of claim 1, wherein a luminance corresponding to the first gamma curve is higher than a luminance corresponding to the second gamma curve.

3. The method of claim 1, further comprising:

applying a fifth data voltage, to which the first gamma curve is applied, to the first pixel, and applying a sixth data voltage, to which the second gamma curve is applied, to the second pixel, during a (N+2)-th frame; and applying a seventh data voltage, to which the third gamma curve is applied to the first pixel, and applying an eighth data voltage, to which the third gamma curve is applied, to the second pixel, during a (N+3)-th frame, wherein a phase of the fifth data voltage is opposite a phase of the first data voltage, a phase of the sixth data voltage is opposite a phase of the second data voltage, a phase of the seventh data voltage is opposite a phase of the third data voltage, and a phase of the eighth data voltage is opposite a phase of the fourth data voltage.

4. The method of claim 1, further comprising:

applying a fifth data voltage, to which the second gamma curve is applied, to the first pixel, and applying a sixth data voltage, to which the first gamma curve is applied, to the second pixel, during a (N+2)-th frame; and applying a seventh data voltage and an eighth data voltage to which the third gamma curve is applied to the first pixel and the second pixel, respectively, during a (N+3)-th frame.

5. The method of claim 4, further comprising:

applying a ninth data voltage, to which the first gamma curve is applied, to the first pixel, and applying a tenth data voltage, to which a second gamma curve is applied, to the second pixel, during a (N+4)-th frame;

applying an eleventh data voltage, to which the third gamma curve is applied, to the first pixel, and applying a twelfth data voltage, to which the third gamma curve is applied, to the second pixel, during a (N+5)-th frame;

applying a thirteenth data voltage, to which a second gamma curve is applied, to the first pixel, and applying a fourteenth data voltage, to which the first gamma curve is applied, to the second pixel, during a (N+6)-th frame; and applying a fifteenth data voltage, to which the third gamma curve is applied, to the first pixel, and applying a sixteenth data voltage, to which the third gamma curve is applied, to the second pixel, during a (N+7)-th frame, wherein a phase of the ninth data voltage is opposite a phase of the first data voltage, a phase of the tenth data voltage is opposite a phase of the second data voltage, a phase of the eleventh data voltage is opposite a phase of the third data voltage, a phase of the twelfth data voltage is opposite a phase of the fourth data voltage, a phase of the thirteenth data voltage is opposite a phase of the fifth data voltage, a phase of the fourteenth data voltage is opposite a phase of the sixth data voltage, a phase of the fifteenth data voltage is opposite a phase of the seventh data voltage, and a phase of the sixteenth data voltage is opposite a phase of the eighth data voltage.

6. The method of claim 1, wherein the first pixel and the second pixel each comprise a plurality of color pixels.

7. The method of claim 1, wherein the first pixel and the second pixel are each a color pixel comprised of a plurality of color pixels.

8. A display apparatus comprising:

a display panel comprising a first pixel and a second pixel adjacent to the first pixel; and a driving apparatus to apply a first data voltage, to which a first gamma curve is applied, to the first pixel during an (N)-th frame, to apply the second data voltage, to which a second gamma curve is applied, to the second pixel during the (N)-th frame, and to apply a third data voltage and a fourth data voltage, to which the third gamma curve is applied, to the first pixel and the second pixel, respectively, during a (N+1)-th frame, wherein the third gamma curve has a luminance between the first gamma curve and the second gamma curve, and N is a natural number.

9. The display apparatus of claim 8, wherein a luminance corresponding to the first gamma curve is higher than a luminance corresponding to the second gamma curve.

10. The display apparatus of claim 8, wherein the driving apparatus comprises:

a timing controlling part to generate conversion data from image data of the (N)-th frame received from an external device by applying the first gamma curve and the second gamma curve, and to generate conversion data from image data of the (N+1)-th frame received from the external device by applying the third gamma curve;

a gamma voltage generating part to generate a gamma reference voltage; and a data driving part to convert the conversion data into a data voltage based on the gamma reference voltage.

11. The display apparatus of claim 10, wherein the timing controlling part comprises:

a gamma conversion part to convert the input image data of n bits into conversion data of n+k bits by applying the first gamma curve and the second gamma curve, or the third gamma curve, per a frame, wherein n and k are natural numbers; and a dithering part to dither the conversion data of n+k bits into conversion data of n bits.

12. The display apparatus of claim 11, wherein the gamma conversion part converts first image data corresponding to the first pixel into first conversion data, to which the first gamma curve is applied, during the (N)-th frame, converts second image data corresponding to the second pixel into second conversion data, to which the second gamma curve is applied, during the (N)-th frame, and converts the first image data and the second image data corresponding to the first pixel and the second pixel into third conversion data to which the third gamma curve is applied during the (N+1)-th frame.

13. The display apparatus of claim 12, wherein the gamma conversion part converts the first image data corresponding to the first pixel into fourth conversion data, to which the second gamma curve is applied, during a (N+2)-th frame, converts the second image data corresponding to the second pixel into fifth conversion data, to which the first gamma curve is applied, during the (N+2)-th frame, and converts the first image data and the second image data corresponding to the first pixel and the second pixel into sixth conversion data to which the third gamma curve is applied during a (N+3)-th frame.

14. The display apparatus of claim 8, wherein the driving apparatus comprises:

a timing controlling part to receive an input image data and a control signal from an external device and to generate a selection signal for selecting a gamma reference voltage by using the control signal;

a gamma voltage generating part to select at least one of a first gamma reference voltage corresponding to the first gamma curve, a second gamma reference voltage corresponding to a second gamma curve, and a third gamma reference voltage corresponding to the third gamma curve in response to the selection signal; and a data driving part to convert the input image data into a data voltage by using the selected gamma reference voltage outputted from the gamma voltage generating part and to outpur the data voltage to the display panel.

15. The display apparatus of claim 14, wherein the gamma voltage generating part comprises:

a gamma voltage selecting part to select at least one of the first gamma reference voltage, the second gamma reference voltage, and the third gamma reference voltage in response to the selection signal; and a gamma voltage outputting part to output the gamma reference voltage selected in the gamma voltage selecting part to a data driving part.

16. The display apparatus of claim 15, wherein the data driving part converts first image data corresponding to the first pixel into the first data voltage by using the first gamma reference voltage during the (N)-th frame, converts second image data corresponding to the second pixel into the second data voltage by using the second gamma reference voltage during the (N)-th frame, and converts the first image data and the second image data respectively corresponding to the first pixel and the second pixel into the third data voltage and fourth data voltage by using the third gamma reference voltage during the (N+1)-th frame.

17. The display apparatus of claim 16, wherein the data driving part converts the first image data corresponding to the first pixel into the fifth data voltage by using the second gamma reference voltage during the (N+2)-th frame, converts the second image data corresponding to the second pixel into the sixth data voltage by using the first gamma reference voltage during the (N+2)-th frame, and converts the first image data and the second image data respectively corresponding to the first pixel and the second pixel into a seventh data voltage and an eighth data voltage by using the third gamma reference voltage during a (N+3)-th frame.

* * * * *